US006550874B2

(12) United States Patent
Walla et al.

(10) Patent No.: US 6,550,874 B2
(45) Date of Patent: Apr. 22, 2003

(54) ADJUSTABLE HANGING FILE SYSTEM

(75) Inventors: Gregg W. Walla, Lake Bluff, IL (US); Richard J. Tracy, Elgin, IL (US); E. Grant Swick, Bartlett, IL (US); William E. Ruehl, Elgin, IL (US)

(73) Assignee: CompX International Inc., Mauldin, SC (US)

( * ) Notice: Subject to any disclaimer, the term of this patent is extended or adjusted under 35 U.S.C. 154(b) by 0 days.

(21) Appl. No.: 09/939,349

(22) Filed: Aug. 24, 2001

(65) Prior Publication Data

US 2003/0038565 A1 Feb. 27, 2003

(51) Int. Cl.[7] ..... A47B 63/00

(52) U.S. Cl. ..... 312/184; 312/348.3

(58) Field of Search ..... 312/183, 184, 312/348.3, 348.5; 206/425; 229/67.2

(56) References Cited

U.S. PATENT DOCUMENTS

| | | | | |
|---|---|---|---|---|
| 529,251 A | | 11/1894 | Edgar | |
| 1,604,995 A | | 11/1926 | Gruhler | |
| 1,671,530 A | | 5/1928 | Kristensson | |
| 1,741,157 A | | 12/1929 | Hutchings | |
| 1,803,823 A | | 5/1931 | Wittenmyer | |
| 1,917,980 A | | 7/1933 | Kelsey | |
| 2,187,113 A | | 1/1940 | Ehrenzweig | |
| 2,336,802 A | | 12/1943 | Posner | |
| 2,564,673 A | | 8/1951 | Chauvin | |
| 3,112,967 A | | 12/1963 | Hood | |
| 3,433,548 A | | 3/1969 | Moore | |
| 3,456,994 A | | 7/1969 | Sullivan | |
| 3,657,101 A | | 4/1972 | Hensch et al. | |
| 3,734,590 A | | 5/1973 | Ormiston et al. | |
| 3,748,008 A | | 7/1973 | Pryor | |
| 3,826,550 A | | 7/1974 | Propst et al. | |
| 3,850,488 A | | 11/1974 | Elias et al. | |
| 3,923,353 A | | 12/1975 | Elias et al. | |
| 3,938,870 A | | 2/1976 | Guest et al. | |
| 3,957,320 A | | 5/1976 | Walter | |
| 4,030,610 A | | 6/1977 | Alexander | |
| 4,049,127 A | | 9/1977 | Alexander | |
| 4,091,933 A | | 5/1978 | Alexander | |
| 4,138,172 A | | 2/1979 | Hansen | |
| 4,176,753 A | | 12/1979 | Godfrey | |
| 4,219,247 A | | 8/1980 | Litchfield et al. | |
| 4,234,238 A | | 11/1980 | Figueroa | |
| 4,290,658 A | | 9/1981 | DeRosa | |
| 4,489,836 A | | 12/1984 | Terrell | |
| 4,527,694 A | * | 7/1985 | Bolt et al. | 312/184 |
| 4,703,982 A | * | 11/1987 | Rock et al. | 312/183 |
| 4,765,490 A | | 8/1988 | Hanson | |
| 4,805,239 A | | 2/1989 | Rock et al. | |
| 4,869,563 A | | 9/1989 | Willer | |

(List continued on next page.)

FOREIGN PATENT DOCUMENTS

| | | | | |
|---|---|---|---|---|
| AU | 257567 | | 5/1963 | |
| CA | 932230 | | 8/1973 | |
| CH | 102257 | | 8/1941 | |
| CH | 246688 | | 10/1941 | |
| CH | 394119 | | 6/1977 | |
| DE | 1249215 | | 9/1967 | |
| DE | 1486756 | | 2/1970 | |
| DE | 3700435 | * | 7/1988 | 312/348.3 |
| DE | 3717950 | * | 12/1988 | 312/184 |
| DK | 53644 | | 9/1937 | |
| EP | 1444191 | | 3/1966 | |
| GB | 1397129 | | 6/1975 | |

OTHER PUBLICATIONS

1249215

*Primary Examiner*—Lanna Mai
*Assistant Examiner*—Hanh V. Tran
(74) *Attorney, Agent, or Firm*—Banner & Witcoff, Ltd.

(57) ABSTRACT

An adjustable hanging file system for a drawer having side panels utilizes frame members comprised of spaced skirts with a connecting crown to thereby define a u-shaped cross section and bracket members inserted between the skirts to support the frame members. Additional hanging bracket members incorporated with cross rail frame members support the cross rail frame members on frame members attached to a file drawer.

20 Claims, 6 Drawing Sheets

U.S. PATENT DOCUMENTS

| | | | | | |
|---|---|---|---|---|---|
| 4,887,873 | A | | 12/1989 | Goedken et al. | |
| 4,911,509 | A | | 3/1990 | Rock et al. | |
| 4,925,258 | A | | 5/1990 | Ludwig et al. | |
| 4,958,795 | A | * | 9/1990 | Bruneau | 312/184 |
| 4,988,006 | A | | 1/1991 | Lundin | |
| 5,042,769 | A | | 8/1991 | Smed | |
| 5,102,210 | A | | 4/1992 | Beals | |
| 5,197,762 | A | * | 3/1993 | Abramov | 312/184 |
| 5,197,791 | A | | 3/1993 | Domenig | |
| 5,205,626 | A | | 4/1993 | Fotioo | |
| 5,214,836 | A | | 6/1993 | Beals | |
| 5,251,974 | A | | 10/1993 | Beals | |
| 5,339,969 | A | | 8/1994 | Filipowski | |
| 5,358,126 | A | | 10/1994 | Jones et al. | |
| 5,370,454 | A | | 12/1994 | Domenig | |
| 5,393,136 | A | | 2/1995 | Gragowski et al. | |
| 5,396,995 | A | | 3/1995 | Turek | |
| 5,405,020 | A | | 4/1995 | Fotioo | |
| 5,433,516 | A | | 7/1995 | Beals et al. | |
| 5,439,280 | A | | 8/1995 | Steinberg et al. | |
| 5,456,531 | A | | 10/1995 | Beals | |
| 5,466,061 | A | | 11/1995 | Lautenschläger | |
| 5,494,175 | A | | 2/1996 | Higdon et al. | |
| 5,515,980 | A | | 5/1996 | Fotioo | |
| 5,525,002 | A | | 6/1996 | Huber | |
| 5,570,792 | A | | 11/1996 | Huang | |
| 5,678,797 | A | | 10/1997 | Gogan | |
| 5,815,903 | A | * | 10/1998 | Foster et al. | 206/425 |
| 5,873,642 | A | | 2/1999 | Domenig | |
| 6,168,031 | B1 | | 1/2001 | Schmidt | |
| 6,168,247 | B1 | * | 1/2001 | Stahmer et al. | 312/183 |
| 6,357,844 | B1 | * | 3/2002 | Muterthies et al. | 312/348.3 |

* cited by examiner

FIG.1
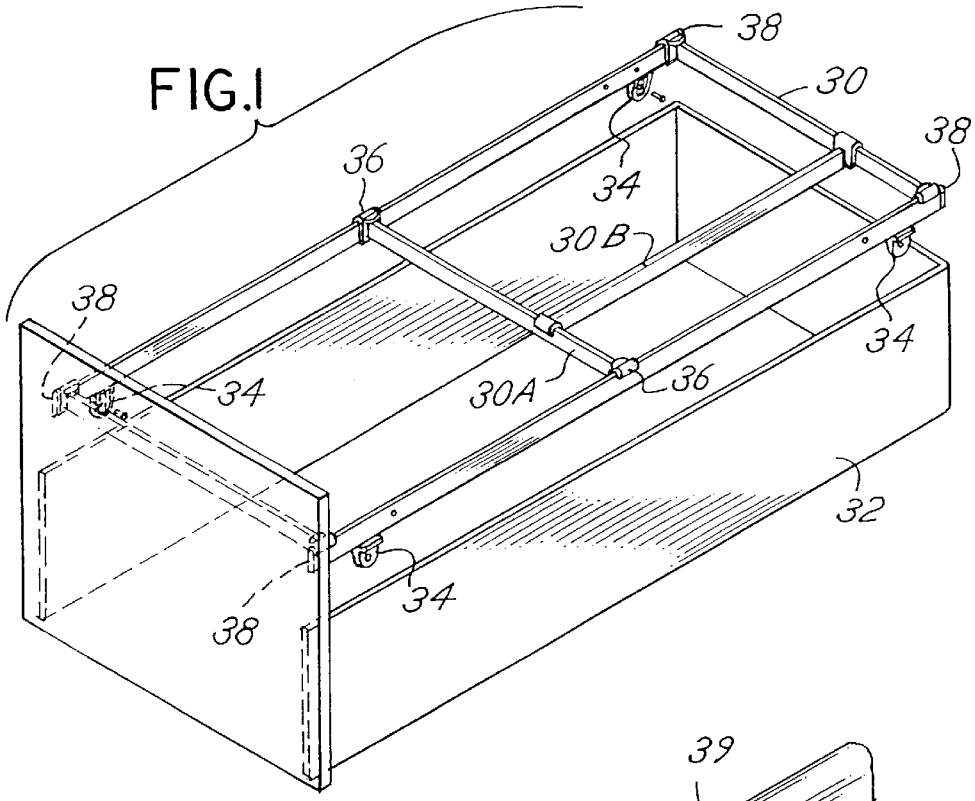
FIG.4
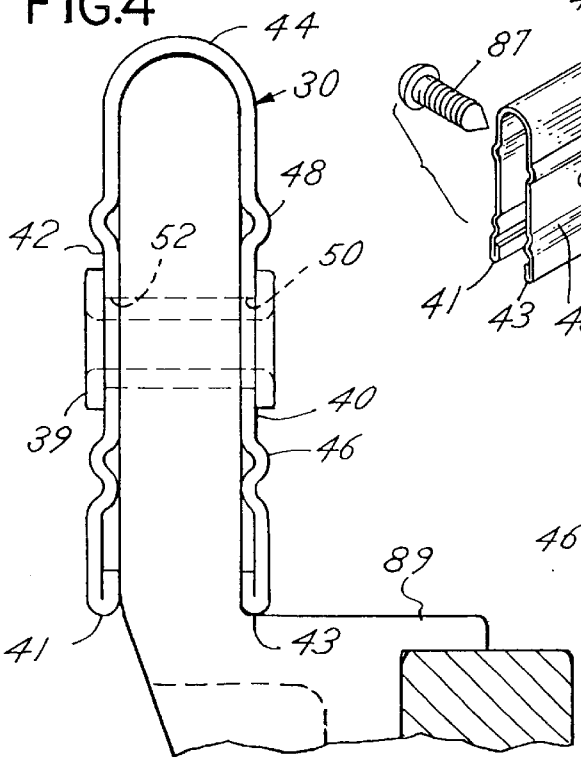
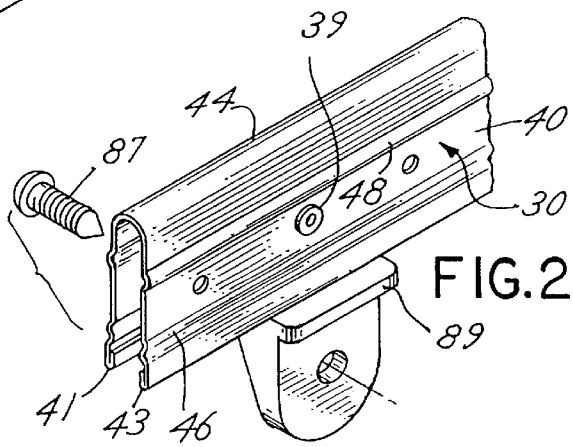
FIG.2
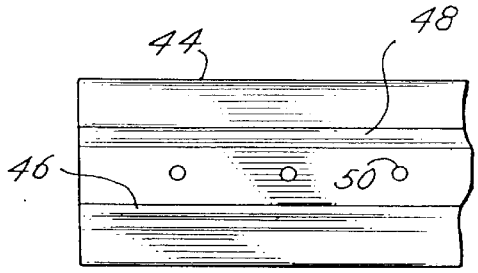
FIG.3

FIG.10
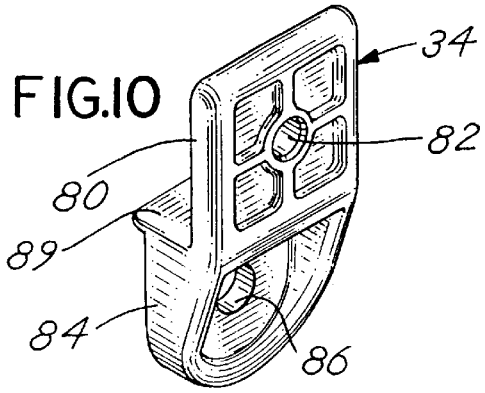
FIG.15
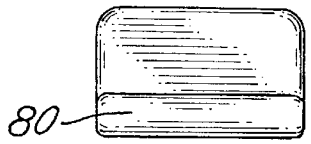
FIG.13
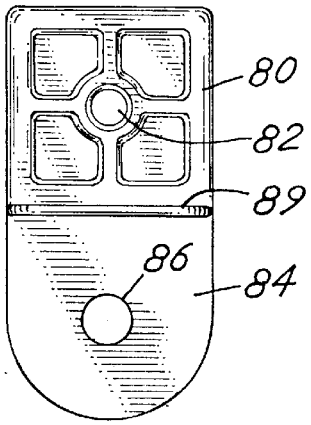
FIG.11
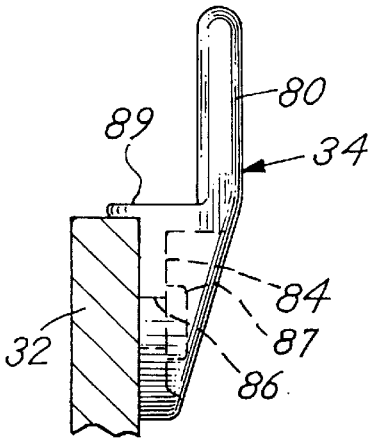
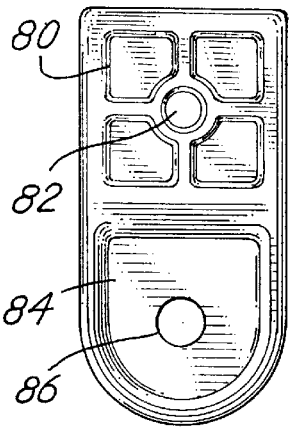
FIG.12
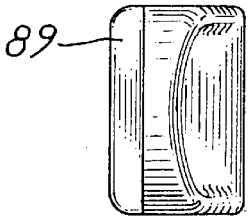
FIG.14

FIG.24
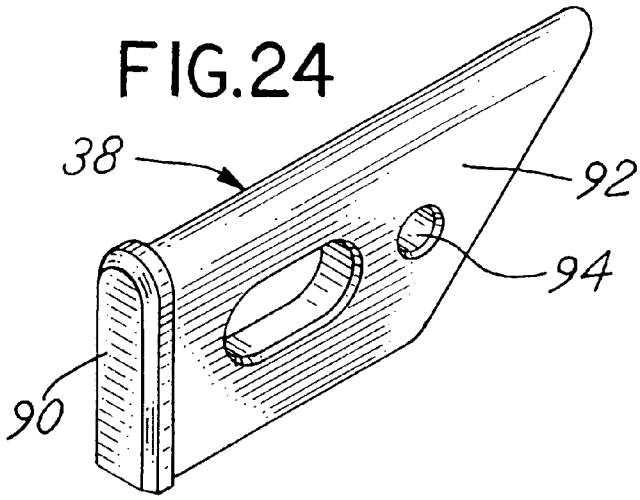
FIG.26
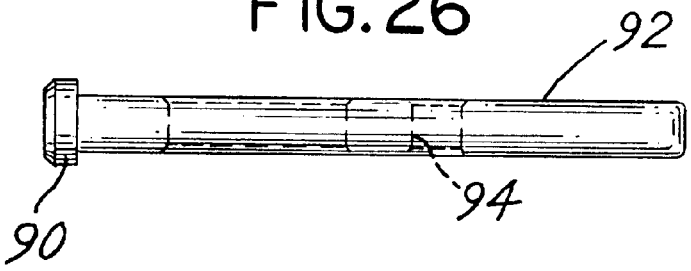
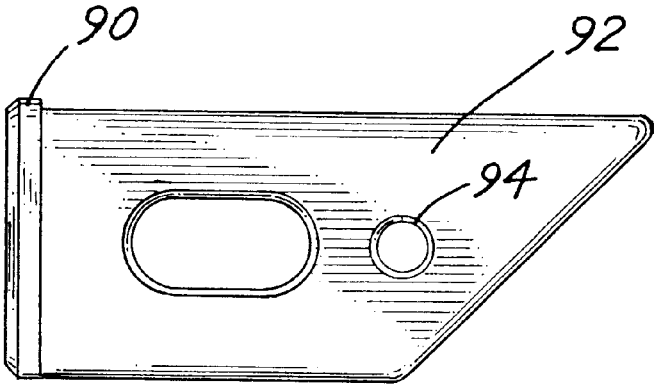
FIG.25

ADJUSTABLE HANGING FILE SYSTEM

BACKGROUND OF THE INVENTION

In a principal aspect, the present invention relates to a system for support of hanging files in a file drawer, and, more particularly to an adjustable hanging file system that may be adjusted to support or accommodate files of various dimensions.

Storage of documents, correspondence and the like in file drawers by means of hanging files is a well-known expedient. There are numerous examples in prior art patents which disclose systems that are installed in file drawers for the purpose of supporting hanging files. For example, U.S. Pat. No. 5,393,136 granted Feb. 28, 1995 for a Drawer With a Convertible Filing Support System discloses a mechanism wherein a file support system may be installed in a file drawer to accommodate various sizes of hanging files. Other patents including the following depict various hanging file systems which may be incorporated into file drawers: U.S. Pat. No. 4,726,635 issued Feb. 23, 1988 for Hanging File Folder Support Assembly for Drawers; U.S. Pat. No. 5,494,175 issued Feb. 27, 1996 for Hanging File Support Structure for a Drawer; U.S. Pat. No. 5,873,642 issued Feb. 23, 1999 for Hanging File Bar Support Assembly for a Drawer; U.S. Pat. No. 5,678,797 issued Oct. 21, 1997 for a Flush Mounted Support Bracket; U.S. Pat. No. 4,887,873 issued Dec. 19, 1989 for a File System with Hang Rail; U.S. Pat. No. 4,869,563 issued Sep. 26, 1989 for a Single Piece Construction File Hanger; U.S. Pat. No. 4,219,247 issued Aug. 26, 1980 for Suspended Filing Drawer; and U.S. Pat. No. 3,456,994 issued Jul. 22, 1969 for a File Folder Suspension For Drawers.

While all of these prior art systems appear to be useful, a need has remained for an improved system which permits ease of adjustment of the hanging file system within a drawer to accommodate hanging files of various sizes with a minimum amount of effort. Concomitantly, a file drawer hanging support system which is rigid and rugged yet is inexpensive, easy to install and requires a minimum amount of tooling in order to install, repair and replace is a desired goal.

SUMMARY OF THE INVENTION

Briefly, the present invention comprises a hanging file system that includes frame members and custom bracket members that are cooperative with the frame members to form a grid in a file drawer which is adjustable to accommodate hanging files of various dimensions. Each frame member is preferably formed with a u-shaped cross section and thus includes a first depending skirt and a spaced, parallel, second depending skirt, the first and second depending skirts being connected by a top crown section thereby resulting in a longitudinal slot in the bottom side between the skirts. The open bottom side or slot of each frame member is adapted to receive support brackets affixed to the sides of a drawer. A grid of frame members may thus be attached to the walls of a drawer. By providing frame members which are comprised of generally parallel, elongate, spaced side skirts connected by a crown to define a bottom slot or channel, one may insert the supporting bracket members into the channel in a manner which avoids interference with hanging files suspended or supported on the top crown of the frame members. The structure of the frame members also enables positioning and secure attachment of the bracket members to the frame members. That is, each bracket member includes a portion or element which fits between parallel skirts of a frame member thereby facilitating attachment of the frame member to the bracket member.

Additional molded brackets or bracket members support cross frame members on the basic grid of frame members attached to a drawer. Further, the spacing of the additional cross frame members is easily adjusted to accommodate various sizes of hanging files.

The construction enables the utilization of light gauge metal which, because of the ability to shape the metal with appropriate reinforcing ribs and ridges including a connecting crown section, enables support of heavy loads by a lighter gauge material.

Thus, it is an object of the invention to provide an improved adjustable hanging file system.

It is a further object of the invention to provide an adjustable hanging file system which is capable of supporting significant loads.

Another object of the invention is to provide a hanging file system which may be manufactured from lighter gauge metal relative to prior art systems, yet which provides significant rigidity and support equivalent to such systems while being lighter in weight and more easily manufactured.

Another object of the invention is to provide a hanging file system which can be easily adjusted to accommodate all sizes of files without utilization of special tools.

Another object of the invention is to provide a hanging file system that can be easily installed in existing file cabinets with a minimal amount of tools and without special installation equipment.

A further object of the invention is to provide a hanging file system that includes bracket members that support frame members on the side walls of a drawer by engaging and fitting against the edge of the drawer walls.

Yet another object of the invention is to provide bracket members cooperative with u-cross section shaped frame members that adjustably engage and support the frame members on a grid of similar frame members attached to the walls of a drawer.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is an exploded isometric view of the adjustable hanging file system of the invention;

FIG. 2 is an isometric view of the frame member utilized in the construction of FIG. 1;

FIG. 3 is a side elevation of the frame member of FIG. 2;

FIG. 4 is an end view of the frame member of FIG. 3;

FIG. 10 is an isometric view of a first embodiment of a frame member support bracket;

FIG. 11 is a edge view of the bracket of FIG. 10;

FIG. 12 is an side view of the bracket of FIG. 11;

FIG. 13 is an opposite side view of the bracket of FIG. 11;

FIG. 14 is a bottom view of the bracket of FIG. 11;

FIG. 15 is a top view of the bracket of FIG. 11;

FIG. 24 is an isometric view of an end cap used in combination with the frame member of FIG. 2;

FIG. 25 is a side elevation of the end cap member of FIG. 25; and

FIG. 26 is a top plan view of the bracket member of FIG. 26.

DESCRIPTION OF THE PREFERRED EMBODIMENT

Figure 5:
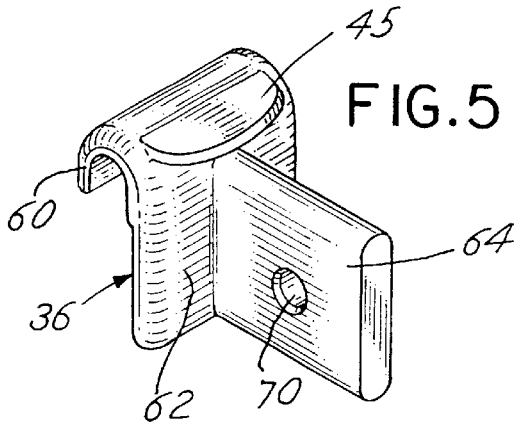
FIG. 5 is an isometric view of a frame cross rail bracket utilized and disclosed in FIG. 1 in an isometric view.
Figure 9:
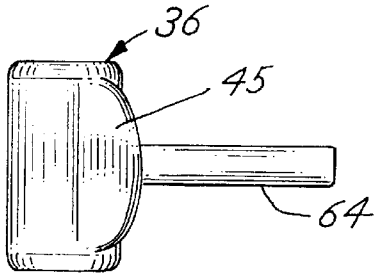
FIG. 9 is a top view of the bracket of FIG. 6.
Figure 8:
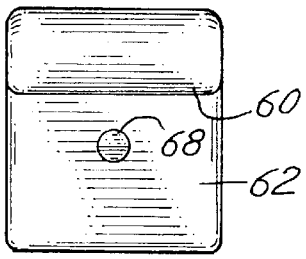
FIG. 8 is the opposite end view of the bracket of FIG. 6.
Figure 6:
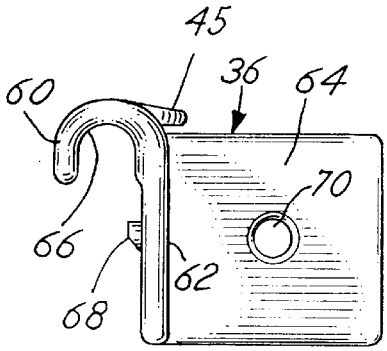
FIG. 6 is a side elevation of the bracket of FIG. 5.
Figure 7:
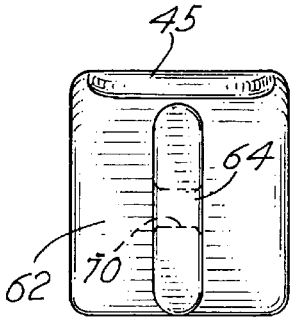
FIG. 7 is an end view of the bracket of FIG. 6.
Figure 16:
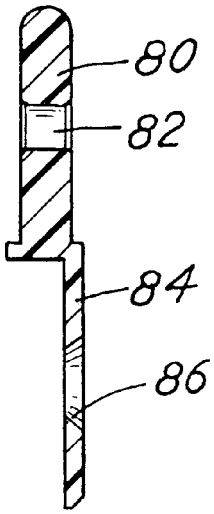
FIG. 16 is a cross sectional view of an alternative bracket for support of a frame member.
Figure 17:
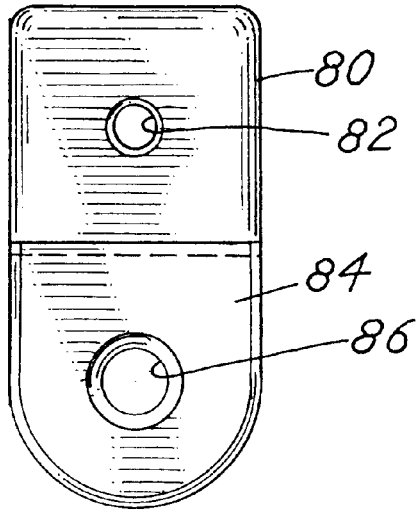
FIG. 17 is a front elevation of the bracket of FIG. 16.
Figure 18:
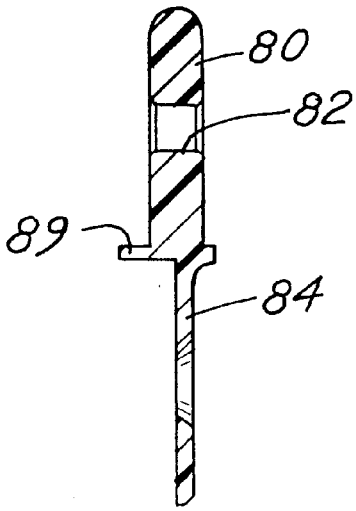
FIG. 18 is a cross sectional view of a third embodiment of a frame member support bracket.
Figure 19:
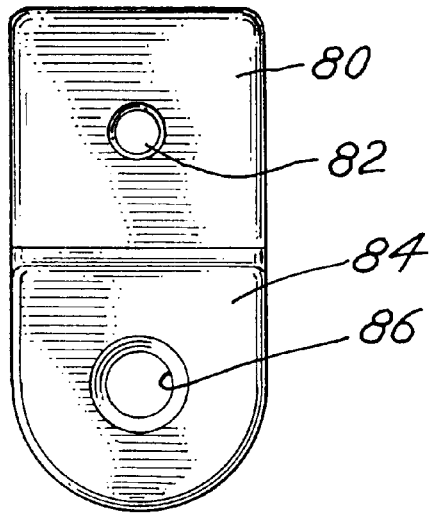
FIG. 19 is a front elevation of the bracket of FIG. 18.
Figure 20:
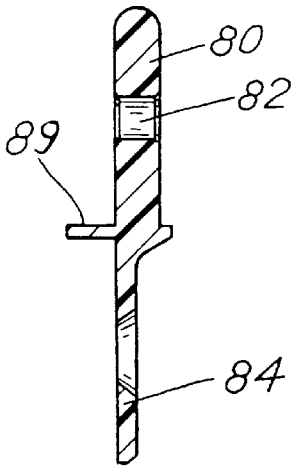
FIG. 20 is a side cross sectional view of a fourth alternative bracket member.
Figure 21:
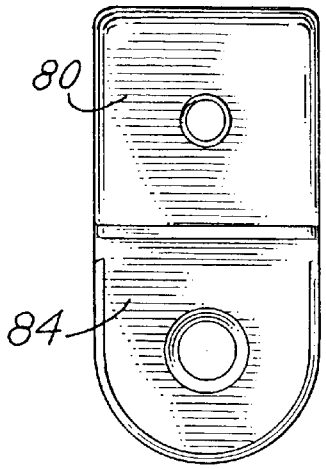
FIG. 21 is a front elevation of the bracket member of FIG. 20.
Figure 22:
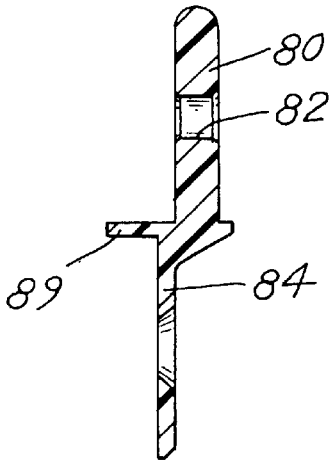
FIG. 22 is a side cross sectional view of a fifth alternative frame member support bracket.
Figure 23:
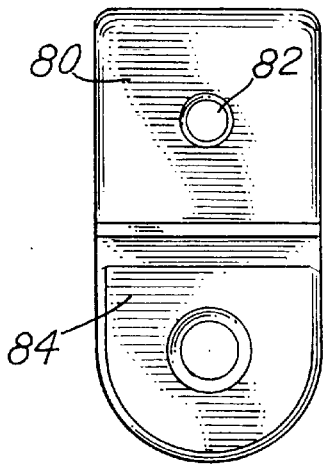
FIG. 23 is a front elevation of the bracket member of FIG. 23.

Referring to the figures, and in particular, FIG. 1, the adjustable hanging file system of the invention is comprised of four basic elements. The first element is a frame member 30. Each frame member 30 comprises an elongate, formed metal rail described in greater detail below. The frame members 30 are supported on the inside of a file drawer cabinet 32 by a second element, molded brackets or bracket members 34. Multiple bracket members 34 support each frame member 30 although the bracket members 34 may be varied in design in accord with the design of the file drawer and the hanging support system installed in the drawer.

The third element is a cross rail bracket or bracket member 36 which is fitted into the ends of frame members 30 thereby enabling such frame members 30 to be supported as cross frame members by the grid of frame members 30 attached to a drawer 32. The fourth element comprises cap members 38 fitted into opposite ends of certain frame members 30.

In sum, there are four basic components in the system: frame members 30, frame member mounting brackets 34, frame support or cross rail brackets or bracket members 36, and frame end caps 38. In the following figures, each of these separate components is depicted and a description is provided. FIGS. 2–4 depict a frame member 30. FIGS. 5–9 depict a cross rail frame support member or bracket 36. FIGS. 10–23 depict various embodiments of frame support brackets 34. FIGS. 24–27 depict an end cap 38 construction.

Referring to FIGS. 2–4, rail or frame member 30 is comprised of a first elongate skirt 40 and a second elongate skirt 42. The skirts 40 and 42 are spaced from one another, are generally parallel and are connected by a crown section or crown 44. Each skirt, for example, skirt 40 includes a series of formed, parallel elongate reinforcing side ribs 46 and 48. The side ribs 46 and 48 provide additional structural integrity for the frame member 30. Various patterns of side ribs 46 may be employed, e.g., continuous, discontinuous, angled, etc.

In the preferred embodiment, the crown 44 has an arcuate shape in cross section, although various other shapes in cross section may be adopted for the connecting crown 44. In the preferred embodiment, the lower edge 41, 43 of each skirt 40 and 42 is folded or formed upwardly and inwardly as depicted in FIG. 4 to avoid any sharp edges from being engaged by a user of the system and to enhance structural integrity. Opposed, aligned openings 50 and 52 in skirts 40 and 42 are provided along the length of the skirts 40 and 42. The openings 50 and 52 define detents through which fasteners, e.g., rivets 39, may be inserted to hold the various component parts together or otherwise cooperatively engage and position the brackets 34, 36 and end cap 38 in a detent position. The brackets 34, as well as end caps 38 are typically held in position by fasteners 39 extending through the openings 50, 52. The cross rail brackets 36 typically include detent projections 68 which engage in the openings 50 or 52 to hold the cross rail brackets 36 and thus the cross rail frame members 30 associated therewith in position.

FIGS. 5–9 illustrate the cross rail support brackets 36. The cross rail support brackets 36 typically include a hook section 60 with a downwardly depending plate 62 extending from hook section 60. The hook 60 includes an inner curved section 66 which is designed to fit over and engage smoothly with the top or outside of crown 44 of a frame member 30. Inside surface of plate 62 includes a projecting prong or tab 68 which is designed to engage with an opening such as opening 50 or 52 in the side of frame member 30.

Extending transversely from the plate 62 is a mounting flange 64. Preferably the mounting flange or transverse plate 64 extends at a right angle from the downwardly extending plate 62. As shown in FIG. 5, the transverse plate 64 also includes a transverse passage 70. The passage 70 may be aligned with openings 50 and 52 for insertion of a fastener, e.g., fastener or rivet 39, therethrough to attach a frame member 30 onto the plate 64. Preferably, bracket 36 includes a lip or flange 45 which is positioned over and spaced from the top edge of plate 62. This lip 45 covers or fits over the crown 44 and end of frame member 30 into which bracket 36 is inserted and thereby functions to prevent files from sticking into or engaging any gap at the attachment end of frame member 30.

FIGS. 10–23 illustrate various embodiments of support brackets 34 that are used in combination with frame members 30 to support or attach frame members 30 onto the sides of a drawer panel 32. Typically, each bracket 34 includes an upwardly projecting tab or section 80 which has a width substantially equal to the width of the space between the skirts 40 and 42. The upwardly projecting section 80 thus has parallel side walls that fits between the inside of skirts 40 and 42. An opening or passageway 82 through the section 80 is provided for receipt of a fastener 39 which attaches the bracket 36 to the frame member 30. Note skirts 40, 42 may be parallel or may diverge slightly outwardly from crown 44.

A downwardly projecting attachment tab on section 84 is provided with an opening 86 for receipt of a fastener 87 to enable attachment of the bracket 36 to a panel 32 such as illustrated in part in FIG. 11. A flange surface 89 projects laterally from the junction between the upper section 80 and the lower section 84 to facilitate alignment of the bracket 36 on the side edge of panel 32 and to support the weight of the frame and files supported by the frame. This flange 89 feature reduces the load on the fasteners 87 as well as facilitating alignment of the bracket and frame members 30.

FIGS. 16–23 illustrate various alternatives for the construction of the support bracket 34 wherein the relationship of the position of the upwardly depending upper section 80 is adjusted relative to the lower bracket attachment section 84. In each instance, however, there are provided separate sections with openings through the center thereof for attachment to a panel 32 and the frame member 30 respectively. Further, a flange 89 is provided in most instances to enable positioning of the bracket 36 appropriately with respect to the edge of a drawer side wall or panel 32. Thus, the orientation and relationship of the frame members 30 relative to the side panels 32 of a drawer may be adjusted to accommodate the design of the drawer. Other types of bracket members 34 may also be provided, for example to recess the frame members 30 within the drawer 32 in alignment with the upper edge of the panels 32 of the drawer. Thus, the particular design of the bracket 34 may be widely varied depending upon the installation to be effected.

FIGS. 24–26 illustrate a typical end cap 38 which fits into or slides into the end of a frame member 30. The end cap 38 includes an outer peripheral flange 90 which limits the extent of insertion of plate on main body 92 of the end cap 38 between the rails 40, 42 of frame member 30. A transverse opening 94 is provided in end cap 38 through which a fastener 3995 may be fitted to retain the end cap 38 in position. The end caps 38 provide an additional protective function to the ends of the frame member 30 and also, because the width of the insert 92 is substantially equal to the distance or width or space between the skirts 40 and 42, the end cap 38 provides additional structural integrity for the frame member or rail 30.

Similarly, the upwardly extending sections 80 of the brackets 34 enhance the structural integrity of the frame members 30. The frame members 30 are made from a lighter gauge steel than many prior art support systems, yet provide wide surfaces, namely, the crown 44 and side skirts 40, 42 upon which hanging files may be rested. The frame members 30 thus are lightweight yet have enhanced structural integrity due to the parallel design and position of the skirts 40, 42 as well as the reinforcing ribs 46 and 48 and the crown 44 all of which promote the structural integrity of the system.

In use, the rails or frame members 30 are cut to a proper length and installed on the opposite sides of the vertical side wall panels 32 forming a drawer and optionally at the rearward and forward ends thereof by means of attachment brackets 34. Additional frame members 30 of appropriate length are then provided with cross member brackets 36 at their opposite ends. Note that the cross member brackets 36 are formed so that the transverse plate 64 is positioned to maintain the surface of crowns 44 in a coplanar relationship with the crowns 44 of frame members 30 that are positioned at right angles with respect thereto. That is, the crowns 44 of all the frame members 30, are all coplanar.

The cross frame members 30 having cross rail brackets 36 thereon are fitted over the frame members 30 mounted on the sides of the drawer 32. The cross frame members (30A in FIG. 1) spacing may be adjusted and the detent projection 68 may engage an opening 50, 52 to maintain the cross frame member (30A in FIG. 1) in a desired spaced position. The cross frame members 30 are easily moved between detent positions to thereby adjust for support of differently sized files. Also the cross frame members 30 may be constructed to extend for the length or width of the drawer and may also form intermediate support frame members (30B in FIG. 1). Thus the arrangement and adjustment of frame members 30 is highly variable and may accommodate a broad range of file sizes and arrays. The crowns 44 of the frame members 30 in the various arrays are coplanar in view of the design of the various cross rail or cross member brackets 34, 36. The end caps 38 are optional elements.

It is possible to vary the construction without departing from the spirit and scope of the invention. For example, as previously noted, the construction of the brackets 34 and 36 may be varied. The cross sectional configuration of the frame members 30 may be varied, eg the shape of the crown 44 and the shape of the side skirts 40, 42. The end cap 38 construction may also be varied and, in fact, end caps 38 may be provided which act to connect and join adjacent frame members 30 arranged at angles to one another or in a linear array. Thus, the end caps 38 may serve as linear connectors of lengths of frame members 30. Therefore, the invention is to be limited only by the following claims and equivalents thereof.

What is claimed is:

1. An adjustable assembly for supporting hanging files in a drawer comprising, in combination:

(a) a support rail comprised of first and second generally parallel, spaced skirts each skirt having a top edge and a bottom edge, said skirts connected together along their top edge by a crown to form a solely u-shaped cross section and spaced at bottom edges to define a slot; and (b) a plurality of bracket members engaging said slot for mounting the support rail on a drawer with the rail crown positioned for file support, each of said bracket members comprising a first element positioned in the slot between the skirts and a second element depending downwardly from between the skirts and from the first element for attachment to a drawer side for support of the rail on said side of a drawer.

2. The assembly of claim 1 further including a plurality of spaced detents in at least one of the first and second skirts along the length thereof, and a fastener for engaging at least one detent to hold a bracket member in a fixed position to said support rail.

3. The assembly of claim 2 comprising a plurality of opposed sets of detents along the length of the first and second skirts.

4. The assembly of claim 2 wherein said detents comprise openings in said skirt and said fastener comprised a pin member for engaging an opening and bracket member.

5. The assembly of claim 2 further including a cross rail bracket member mounted on a rail, said cross rail bracket member including a first cross rail crown engaging section for fitting over the crown of said rail and a laterally projecting cross rail frame section for engaging and supporting a separate support rail.

6. The assembly of claim 5 further including a cross rail bracket member fastener for engaging at least one detent in a rail to thereby retain the cross rail bracket member in a fixed position.

7. The assembly of claim 5 further including a separate support rail, said separate support rail comprising first and second generally parallel, spaced skirts having a top edge and a bottom edge with the top edges connected by a crown to provide a solely u-shaped cross section and wherein the laterally projecting cross rail frame section is fitted intermediate the separate support rail skirts to support the support rail.

8. An adjustable hanging file system for supporting hanging files in a drawer having side panels, said system comprising, in combination:

a frame member formed in a u-shaped cross section with a depending first skirt, a depending second skirt spaced from the first skirt, and a crown connecting the first and second skirts, said skirts defining an open bottom slot;

a frame support bracket including a frame member engaging section and a drawer attachment section for fastening the bracket to a drawer side panel, said frame member engaging section insertable in said slot between the first and second skirts to support the frame member; and at least one frame cross rail assembly, said cross rail assembly including a cross rail bracket having a crown engaging section and a cross rail frame member section, said frame cross rail assembly further including a cross rail frame member having first and second depending, spaced rail frame skirts and a connecting rail frame crown, said crown engaging section of said cross rail bracket positionable over said frame member crown and said cross rail frame member section of said cross rail bracket projecting from the crown engaging section for insertion between the skirts of the cross rail frame member to support the cross rail frame member.

9. The system of claim 8 including a fastener for attachment of the frame support bracket to the frame member.

10. The system of claim 8 wherein the frame support bracket frame member engaging section comprises a flange having a thickness substantially equal to the spacing of the first and second skirts to enable insertion of the flange between the skirts.

11. The system of claim 8 wherein the drawer attachment section extends from the frame member engaging section, and further including a land for separating the sections and for engaging a panel to align the frame support bracket on the panel.

12. The system of claim 8 wherein the frame member includes a detent and the cross rail bracket includes a detent member for cooperatively engaging the frame member detent to thereby hold the cross rail bracket on the frame member.

13. The system of claim 8 wherein the cross rail bracket crown section comprises a formed section which fits over the frame member crown and a planar flange fitted against a skirt of said frame member; and said frame member section projects outwardly from the planar flange for support of said cross rail frame member by fitting between the first and second cross rail frame member skirts.

14. An adjustable hanging file system for supporting hanging files in a drawer, said drawer having side panels, said system comprising, in combination:

(a) a frame member having a first skirt, a generally parallel, spaced second skirt and a crown connecting the first and second skirts to form said frame member with a u-shaped cross section;

(b) a frame member support bracket having a frame member engaging section for positioning between the first and second skirts to support said frame member, said frame member support bracket also including a drawer attachment (c) at least one cross rail assembly bracket, said cross rail assembly bracket including a frame member crown engaging section and a cross rail frame member support section projecting from the crown engaging section and adapted for insertion between spaced, generally parallel skirts of a separate frame member comprising first and second spaced, generally parallel skirts; and (d) said frame member including at least one detent, and said cross rail assembly bracket including a detent member for cooperatively engaging the detent and holding said cross rail assembly bracket in a fixed position on the frame member.

15. The assembly of claim 14 further including at least one separate frame member, said separate frame member comprising first and second spaced generally parallel depending skirts connected by a crown to provide a u-shaped cross section for receipt of said cross rail frame member support section.

16. The assembly of claim 14 including at least one detent in one of said frame member skirts.

17. The assembly of claim 14 including at least one pair of opposed detents in said frame member skirts.

18. An adjustable hanging file system for supporting hanging files in a drawer, said drawer having side panels, said system comprising, in combination:

(a) a frame member having a first depending skirt, a generally parallel, depending spaced second skirt with a crown connecting the first and second skirts to form said frame member with a u-shaped cross section;

(b) a frame member support bracket having a frame member engaging section for positioning between the first and second skirts to support said frame member, said frame member support bracket also including a drawer attachment section for attachment to a drawer side to thereby support said frame member on said drawer side; and (c) at least one cross rail assembly bracket, said cross rail assembly bracket including a frame member crown engaging section for fitting over the frame member crown, a cross rail frame member support section projecting from the crown section, and a planar flange fitted against a skirt of said frame member, said cross rail frame member support section adapted for insertion between spaced, generally parallel skirts of a separate frame member having first and second generally parallel skirts.

19. The assembly of claim 18 wherein the flange of said cross rail assembly bracket includes a detent element for positioning the cross rail assembly bracket on the frame member.

20. The assembly of claim 18 further including a cross rail frame member supported by the cross rail assembly bracket.

* * * * *